United States Patent [19]

Intveld

[11] Patent Number: 4,798,512

[45] Date of Patent: Jan. 17, 1989

[54] LOADER BOOM CONSTRUCTION

[75] Inventor: Dwayne J. Intveld, Hazel Green, Wis.

[73] Assignee: Deere & Company, Moline, Ill.

[21] Appl. No.: 96,419

[22] Filed: Sep. 11, 1987

[51] Int. Cl.[4] ..... E02F 3/36

[52] U.S. Cl. ..... 414/722; 414/697

[58] Field of Search ..... 414/680, 685, 697, 722; 403/154; D15/32

[56] References Cited

U.S. PATENT DOCUMENTS

| | | | |
|---|---|---|---|
| D. 167,758 | 9/1952 | Michaels et al. | 414/697 X |
| D. 204,246 | 4/1966 | Shumaker | D15/32 |
| D. 214,833 | 8/1969 | Glommen | D15/32 |
| 4,156,488 | 5/1979 | Stark | 414/697 |
| 4,439,089 | 3/1984 | Anderson et al. | 414/722 |

FOREIGN PATENT DOCUMENTS

| | | | |
|---|---|---|---|
| 2948480 | 6/1951 | Fed. Rep. of Germany | 414/697 |
| 1206360 | 12/1965 | Fed. Rep. of Germany | 414/697 |
| 2827283 | 1/1979 | Fed. Rep. of Germany | 414/697 |
| 8601241 | 2/1986 | PCT Int'l Appl. | 414/722 |

*Primary Examiner*—Robert J. Spar
*Assistant Examiner*—P. McCoy Smith

[57] ABSTRACT

An articulated four-wheel drive loader has a forward vertically swingable boom that is controlled by a pair of hydraulic cylinders acting between the main frame of the loader and a pair of parallel, transversely spaced boom arms that are interconnected by a transverse tube. A pair of tabs are respectively welded to the tube a short distance from the opposite ends of the tube, and the piston ends of the cylinders are respectively connected to the boom arms by a transverse pin extending through aligned bores in the tabs, eye members attached to the ends of the hydraulic cylinder piston rods, and the boom arms.

6 Claims, 1 Drawing Sheet

34
50
40
48
42
46
36
28
38
22
10
24
30
52
54
32
18
12
16
20
14

50
28
48
40
42
24
44
60
70
68
26
30
62
66
66
60
58
62
64
38
58
56
56

LOADER BOOM CONSTRUCTION

BACKGROUND OF THE INVENTION

This invention relates to a material handling machine having a vertically swingable boom, such as a loader, and more particularly to an improved means for connecting the boom lift cylinders to the boom on such a machine.

Industrial loaders used in the construction and mining industries and the like vary in size from relatively small, light duty machines to huge, heavy duty machines having buckets capable of handling in excess of ten cubic meters of material. The larger machines conventionally have articulated main frames having pivotally connected front and rear frame sections respectively supported on front and rear drive wheels, the loader engine and cab normally being disposed on the rear frame section, while the front frame section carries the loader boom. The loader boom is conventionally raised and lowered by means of a pair of hydraulic cylinders having one end connected to the front loader frame section and their piston rod ends connected to transversely spaced boom arms. The boom arms are normally rigidly interconnected by one or more transverse members. Obviously, the boom lift cylinders on the larger machines are relatively large and very large forces are transmitted from the cylinders to the boom arms when the loader is driven into a pile of material that is to be loaded or in breaking out and raising the material after the bucket is loaded.

One way of attaching the cylinder rods to the loader arms has been to provide a yoke on the end of the cylinder rod with a transverse pin extending through the yoke and a portion of the boom arm. In such a case, the cylinder is disposed in the same vertical plane as the loader arm, and a relatively large yoke is required to transmit the forces involved. Also, the single thickness of the boom arm absorbs the entire load.

Another structure for connecting the cylinders to the boom arms has included an eye member with a transverse bore on the end of the cylinder rod and a pair of vertical plates welded to opposite sides of the boom arm, with a transverse pin extending through aligned bores in the two plates and the eye member. Again, in such an arrangement, the cylinders are in the same vertical plane as the boom arms. Obviously, the two mounting plates have to be relatively large and the welds extensive to accommodate the forces involved.

SUMMARY OF THE INVENTION

According to the present invention, there is provided a simple and relatively inexpensive structure for connecting the boom lift cylinders to the boom while providing the necessary strength in the connection. More specifically, a pair of tabs are welded onto a transverse tube or member that interconnects the boom arms adjacent the respective opposite ends of the transverse tube, and the boom arms are provided with a protrusion or extension opposite the respective tabs. The space between the boom arm and the tab is the same as the width of the eye member on the end of the cylinder rod, and transversely aligned bores in the tabs, boom arms, and eye members reeeive the pins that connect the cylinders to the boom arm. Thus, only half the force exerted by the cylinders is exerted directly to the boom arms, while the other half of the force is exerted on the transverse tube via the tabs.

An important feature of the invention resides in the fact that the above is accomplished with only the addition of relatively small tabs that are welded to the tube, as opposed to a pair of relatively large plates welded to the opposite sides of the boom arm.

Still another feature of the invention resides in the fact that the cylinders are offset inwardly from the boom arms. Thus, for a given transverse spacing of the cylinders, the boom arms can be spaced a wider distance apart to reduce the torsional loading of the boom when the loader bucket is unevenly loaded.

DESCRIPTION OF THE PREFERRED EMBODIMENT

Figure 1:
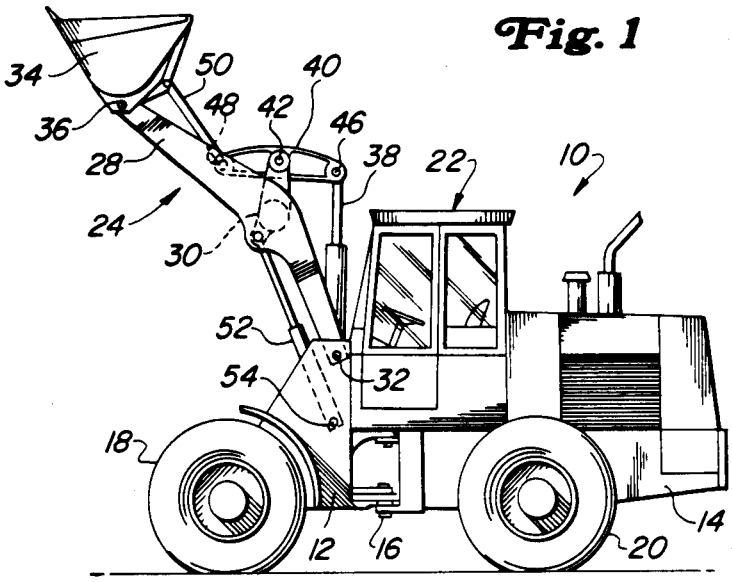
FIG. 1 is a side elevational view of an articulated four-wheel drive loader embodying the invention.
Figure 2:
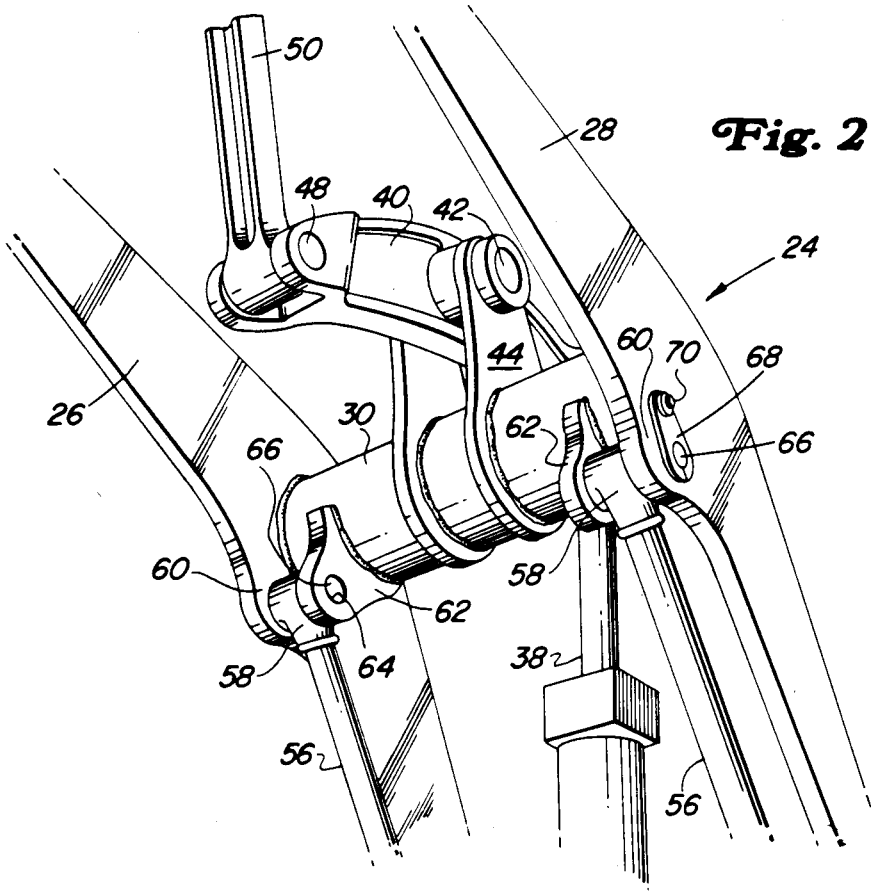
FIG. 2 is a front perspective view of the central portion of the loader boom showing the improved connection of the boom lift cylinders to the boom.

The invention is embodied in an articulated four-wheel drive loader having a main frame or body 10 that includes a front frame 12 pivotally connected to a rear frame 14 by means of vertical pivots 16, the loader being steered by swinging of the front frame relative to the rear in the well-known manner. The front and rear frames are respectively supported on front and rear drive wheels 18 and 20, and an operator's station 22 is provided on the rear frame generally above the pivots 16.

Mounted on the front frame is a forwardly extending boom 24 that is partly formed by right and left parallel arms 26 and 28 respectively. The arms are connected by a transverse cylindrical tube 30 that is welded between the two arms. As is apparent, the arms have an angle in the area where the cross tube 30 connects the arms. The rear end of the boom is connected to the front frame 12 by a transverse pivot 32, and a loader bucket 34 is mounted on the forward end of the boom 24 by a transverse pivot 36. The position of the bucket 34 on its pivot 36 is controlled by a hydraulic cylinder 38 that is connected to the bucket by means of a rocker arm 40 mounted on a transverse pivot 42 carried in a support 44 welded to the cross tube 30. The cylinder 38 is connected to the rear of the rocker arm 40 by a transverse pivot 46, and a second transverse pivot 48 at the front of the rocker arm 40 supports the rear end of a link 50 that has its forward end pivotally connected to the bucket.

The vertical position of the boom 24 is controlled by a pair of parallel, transversely spaced hydraulic cylinders 52 having their lower or cylinder ends connected to opposite sides of the front frame 12 by means of coaxial pivots 54. The cylinders 52 include piston rods 56 having eye members 58 mounted on the ends of the piston rods 56. The eye members 58 have transversely aligned bores. The boom arms are provided with tab-like protrusions or projections 60 on the underside of the arms immediately adjacent to the opposite ends of the cross tube 30. A pair of tabs 62 are welded to the underside of the cross tube adjacent the opposite ends of the cross tube, each tab 62 being spaced from the adjacent boom arm a distance that is only slightly greater than the width of the eye members 58 on the ends of the piston rods 56. The tabs 62 have a transverse bore 64 that is the same diameter as the bore in the eye members 58, and a similar bore is provided in the protrusions 60 on the boom arms in alignment with the bores 64. A transverse pin 66 is mounted in the bore 64 in one tab, the bore in one eye member 58, and the bore through the adjacent boom arm 26 to connect the right cylinder to the boom, and a similar pin 66 through the bore 64 in the left tab, the bore in the left eye member 58, and the bore in the left boom arm 28 connect the left cylinder to the boom. A retainer member 68 is welded to the outer end of each pin 66 and is releasably connected to the boom arm by a bolt-type fastener 70 to releasably lock the pins 66 in place.

As is apparent, the above connection of the cylinders to the boom provide a high-strength, simple, and inexpensive structure that is relatively simple to fabricate.

I claim:

1. In a material handling machine having a main frame that pivotally supports a vertically swingable boom having a pair of transversely spaced boom arms that are rigidly interconnected by at least one transverse tube extending between the arms and a pair of parallel hydraulic cylinders respectively having one end connected to the frame and an eye member having a transverse bore and mounted on the other end, the combination therewith of improved means for connecting said respective other ends of the cylinders to the boom comprising:

a cylinder mounting area integral with each boom arm adjacent to and offset from the opposite ends of the cross tube;

a pair of tabs respectively rigidly mounted on and adjacent to the opposite ends of the cross tube, the tabs being respectively spaced from the respective arms approximately the same distance as the width of the respective eye members;

a transverse bore through the respective boom arm mounting areas and cross tube tabs, the eye members of the respective cylinders being disposed between the respective mounting areas and cross tube tabs with the eye member bore aligned with the bores in the mounting areas and tabs;

and a pair of removable pins respectively extending through the bores in the mounting areas, eye members and tabs to connect the ends of the cylinders to the boom.

2. The invention described in claim 1 and including a locking means mounted on the outside of each boom arm adjacent the bore in the mounting area and operative to releasably retain the pins in the respective bores.

3. The invention described in claim 2 wherein each locking means includes a retainer member connected to the pin and a fastener means operative to releasably fasten the retainer to the outer side of the boom arm.

4. The invention described in claim 1 wherein the mounting area on each boom arm is formed by an integral protrusion extending from the underside of the boom arm.

5. The invention described in claim 1 wherein each cylinder is offset inwardly from its respective boom arm.

6. The invention described in claim 1 wherein the cross tube is cylindrical and the tabs are respectively welded to the outer surface of the cross tube.

* * * * *